United States Patent [19]

Thoma

[11] Patent Number: 4,558,192

[45] Date of Patent: Dec. 10, 1985

[54] MULTI-RANGE TIMER SWITCH DEVICE

[75] Inventor: Friedrich X. Thoma, Haslach, Fed. Rep. of Germany

[73] Assignee: Dieter Graesslin Feinwerktechnik, Fed. Rep. of Germany

[21] Appl. No.: 452,727

[22] Filed: Dec. 23, 1982

[51] Int. Cl.[4] ..... H014 7/08

[52] U.S. Cl. ..... 200/35 R; 200/38 D

[58] Field of Search ..... 200/38 D, 38 DA, 38 DB, 200/38 FA, 38 FB, 38 C, 38 A, 38 BA, 35 R, 38 DC; 368/107, 184; 46/248, 249, 255

[56] References Cited

U.S. PATENT DOCUMENTS

| | | | |
|---|---|---|---|
| 1,914,018 | 6/1933 | Hollerith | 116/249 |
| 1,958,282 | 5/1934 | Tregenza | 116/248 |
| 3,376,757 | 4/1968 | Papa, Jr. . | |
| 3,454,909 | 7/1969 | Koehler | 335/65 |
| 3,487,699 | 1/1970 | Pettersson et al. . | |
| 4,130,748 | 12/1978 | Schwer | 200/38 D |

FOREIGN PATENT DOCUMENTS

| | | | |
|---|---|---|---|
| 0051282 | 10/1981 | European Pat. Off. | 200/35 R |
| 1807401 | 6/1969 | Fed. Rep. of Germany . | |
| 1801823 | 5/1970 | Fed. Rep. of Germany . | |
| 2432811 | 1/1976 | Fed. Rep. of Germany . | |
| 2905472 | 8/1979 | Fed. Rep. of Germany . | |
| 2835518 | 2/1980 | Fed. Rep. of Germany . | |
| 3002570 | 7/1981 | Fed. Rep. of Germany . | |
| 2232068 | 1/1974 | France . | |

*Primary Examiner*—E. A. Goldberg
*Assistant Examiner*—Mark Reinhart
*Attorney, Agent, or Firm*—Hill, Van Santen, Steadman & Simpson

[57] ABSTRACT

A multi-range timer switch device has a rotatable switching disc or drum carrying a number of programmable switch actuators for actuating a stationary switch and has a dial face with two scale divisions thereon for designating elapsed time, and has a coupling device interconnected between the time disc or barrel and at least two drive trains for respectively rotating the disc or barrel at different speeds. When said coupling is shifted from one drive speed to the other, the corresponding dial face having appropriate scale divisions is made visible. The scale divisions of the dial face can assume only one position relative to the switching disc or drum so that the divisions can be unambiguously and easily set to the appropriate time when a shift is made from one drive speed to the other.

27 Claims, 10 Drawing Figures

FIG. 1
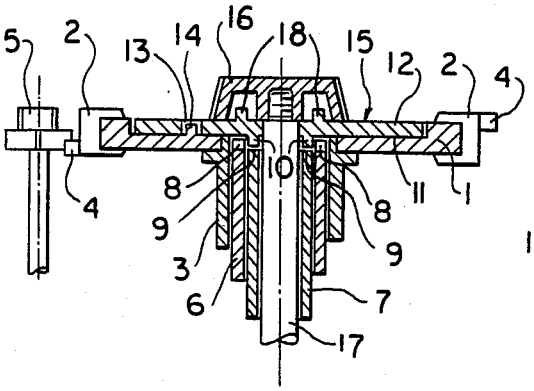
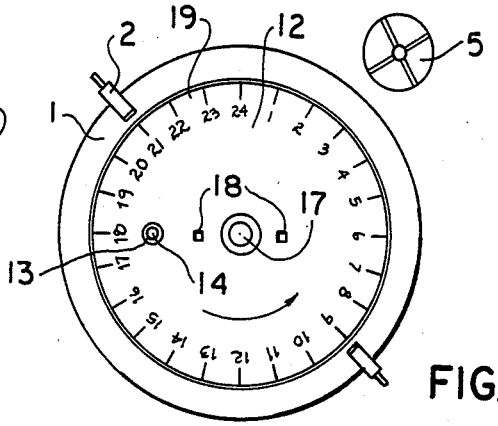
FIG. 2
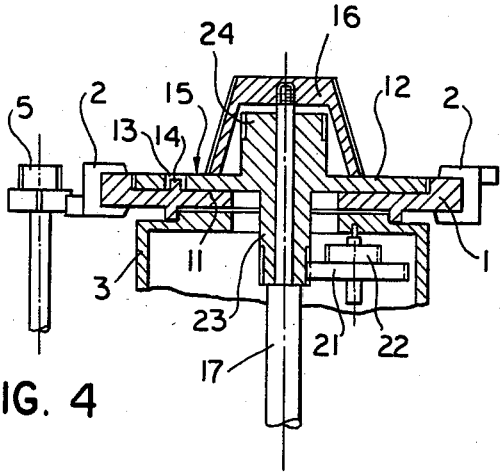
FIG. 4
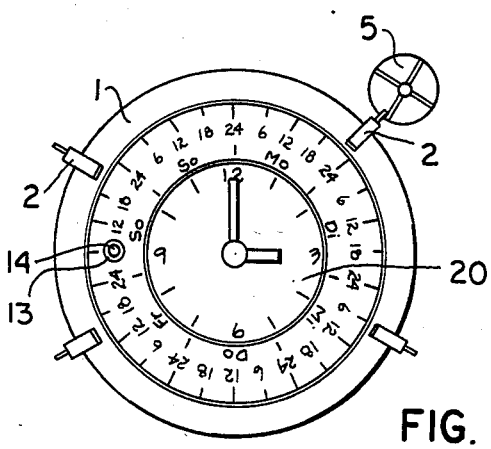
FIG. 3
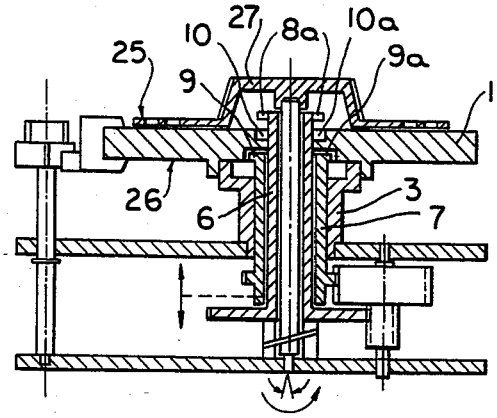
FIG. 6
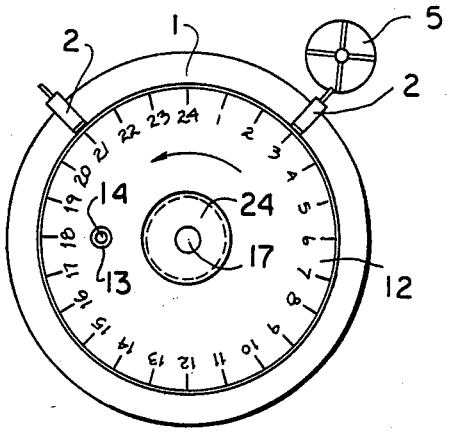
FIG. 5

FIG. 7
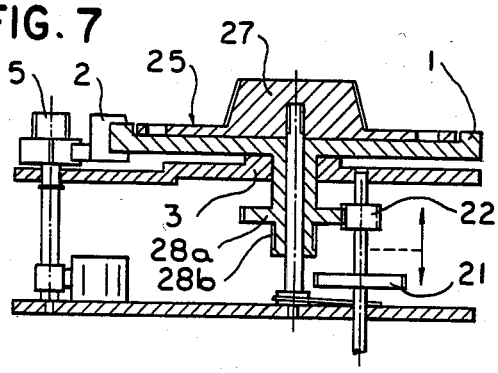
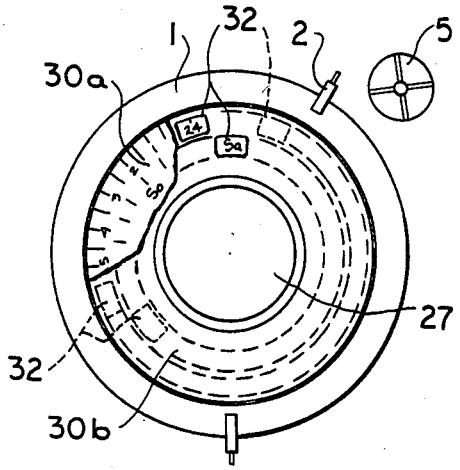
FIG. 8
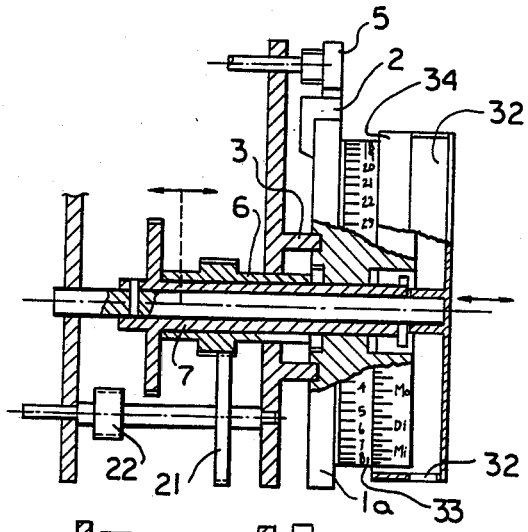
FIG. 9
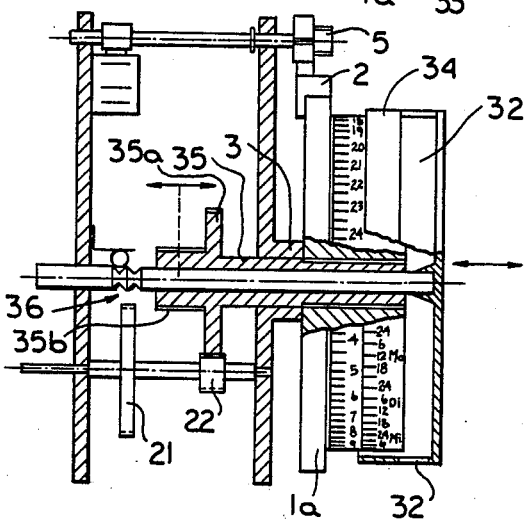
FIG. 10

MULTI-RANGE TIMER SWITCH DEVICE

BACKGROUND OF THE INVENTION

1. Field of the Invention

The present invention relates to multi-range timer switch devices, and in particular to such a device for actuating a stationary switch means and having a scale division thereon corresponding to the speed of rotation of the timer switch device.

2. Description of the Prior Art

Timer switch discs are widely known and used for controlling a sequence of events wherein each event is initiated by the actuation of a switch by the timer device. Such timer devices have application in switching clocks, cycle control means, and time lag relays, as well as many other types of devices well known to those skilled in the art. For many such applications, it is particularly useful to select the time range for the timer device, which is governed by the speed of rotation of a programmable switching means, such as a disc, to be a standard daily, weekly, monthly or annual program.

Timer devices as described above are known in the art which utilize a synchronous motor and which provide daily and weekly program time ranges. In order to change from one program range to another, such devices include a mechanical gearing or drive train between the drive means and the switching disc by means of which the rotational speed of the switching disc can be changed, for example, from one revolution per 24 hours to one revolution per week, and vice versa. Such a switching device is described in German OS No. 2,835,518. This conventional timer has the disadvantage, however, that in addition to shifting the gears in order to change the period of revolution of the switching disc, it is also necessary to independently manually change the dial face for the disc in order to coordinate the time divisions on the dial face with the new rotational speed.

Because of the necessity of undertaking two separate and independent operations, namely shifting gears and changing dial faces, in conventional timer switching devices, errors may arise when only one of these operations is undertaken. Moreover, in such conventional devices it is difficult to precisely correlate the position of the divisions of the new dial face with the switching disc in order to accurately reflect elapsed time during the new rotational speed of the disc.

Another timer disc is described in German OS No. 3,002,570 which has a one-piece switching disc having a daily switching program on one side thereof and a weekly switching program on the other side so that the disc need only be turned over in order to alter or change the time range as well as the rotational speed of the disc. For engaging the appropriate drive train, the disc carries corresponding gear rims which are respectively engaged with a pinion of the appropriate drive train depending upon which side of the disc is facing up (that is, is visible). Thus the gear rim for the daily time range is disposed on the face of the disc having a scale division for the weekly time range, and the gear rim for the weekly time range is disposed on the face of the disc with the scale division for the daily time range. This known device still, however, presents problems in accurately setting the particular dial face in use to the time of day at which the change-over from one rotational speed to the other is made, due to the pitch of the teeth in the respective gear rims relative to the central pinion of the drive train which engages the gear rims. Moreover, the position of the switching disc must still be adjusted relative to the switch actuators.

SUMMARY OF THE INVENTION

It is an object of the present invention to provide a multi-range timer switch device wherein the speed of rotation of a switching disc and the corresponding dial face display and scale division can be easily changed with chronological precision and without changing the topical position of the switching disc in the area of its engagement with the switch means.

It is a further object of the present invention to provide such a multi-range timer switch device which can be precisely and clearly set relative to an existing dial train displaying time in analog form.

The above objects are inventively achieved in a multirange timer switch device having a coupling means interconnected between a rotatably seated switching disc and at least two drive trains operating at different speeds. The coupling means can be easily operated upon to couple the switching disc to one of the different drive trains having a selected speed and to simultaneously expose or make visible the scale division on the switch disc or on the coupling device itself which corresponds to the selected rotational speed.

The drive trains of different speeds are branched by means of different gear stages from a central drive means. The coupling means may be in the form of positive clutches, toothed clutches, or cam clutches. The scale divisions of the standard dial faces may be directly disposed on the switching disc or on a switching drum, or may be directly disposed on the coupling device itself.

DESCRIPTION OF THE DRAWINGS

FIG. 1 is a cross-sectional view of a switching device having a coupling means constructed in accordance with the principles of the present invention.

FIG. 2 is a plan view of the device shown in FIG. 1.

FIG. 3 is a plan view of a further embodiment of the device shown in FIG. 2 with a clock mechanism coaxially disposed relative to the switching disc.

FIG. 4 is a cross-sectional view of a second embodiment of a multi-range timer switch with a coupling means constructed in accordance with the principles of the present invention.

FIG. 5 is a plan view of the device shown in FIG. 4.

FIG. 6 is a cross-sectional view of a third embodiment of a timer switching device having a coupling means constructed in accordance with the principles of the present invention.

FIG. 7 is a cross-sectional view of a fourth embodiment of a timer switching device having a coupling means constructed in accordance with the principles of the present invention.

FIG. 8 is a plan view of both of the devices shown in FIGS. 6 and 7.

FIG. 9 is a cross-sectional view of a first embodiment of a timer switch device having a switching barrel constructed in accordance with the principles of the present invention.

FIG. 10 is a cross-sectional view of a second embodiment of a timer switch device having a switching barrel constructed in accordance with the principles of the present invention.

DESCRIPTION OF THE PREFERRED EMBODIMENTS

A timer switch device constructed in accordance with the principles of the present invention is shown in FIG. 1 having a switching disc 1 mounted on a rotatable tubular bearing pin 3 for corotation therewith. The switching disc 1 carries a plurality of switch actuators or riders 2 at its circumference which, in conformity with a switching program, actuate a stationary switch means 5 by means of switch cams 4.

Two separate drive tubes 6 and 7 are coaxially mounted with respect to the bearing pin 3, each of the drive tubes 6 and 7 rotating at different speeds by means of suitable gearing with a central drive means, which is not illustrated in greater detail and which may be of any type well known to those skilled in the art such as a synchronous motor or a crystal-controlled motor. The drive tube 6 may, for example, make one revolution per 24 hours and the drive tube 7 may, for example, make one revolution per week. The drive tube 6 is provided with a coupling recess 8 at an end face thereof, and the drive tube 7 is provided with a similar coupling recess 9 at its end face.

In the embodiment shown in FIG. 1, the coupling recess 9 for the drive tube 7 engages a corresponding radially aligned coupling dog 10 disposed at the underside 11 of a dial face 12, the engagement of the coupling recess 9 and the coupling dog 10 forming the final link in the drive train or coupling between the central drive means and the switching disc 1. The dial face 12 is coupled to the switching disc 1 by means of a clutch aperture 13 in the dial face 12 which engages a corresponding dog 14 carried on the switching disc 1. In this particular coupling configuration, the switching disc 1 will execute one revolution every 24 hours. Accordingly, a 24 hour scale division is provided on the upper face 15 of the dial face 12, as shown in greater detail in FIGS. 2 and 3.

When the speed of the switching disc 1 is to be changed to one revolution per week, an axial limiting nut 16 on a stationary threaded bolt 17 is unscrewed and the dial face 12 is removed from the switching disc 1 and turned over and re-engages with the switching disc 1 by means of the clutch aperture 13 and the dog 14. A coupling dog 18 disposed in a corresponding radial configuration on what was previously the upper face 15 now engages the coupling recess 9 of the drive tube 7. The nut 16 is re-attached. In this coupling configuration, the switching disc 1 now executes one revolution per week. A weekly scale division is provided on what is now the upper face, which was previously the lower face 11.

The rotational speed of the timer device can thus be simply, unmistakeably and reliably changed by simply turning over the dial face 12, making visible either a scale division 19 for one revolution per 24 hours as shown in FIG. 2, or one revolution per week as shown in FIG. 3 corresponding to the selected rotational speed or time range of the switching disc 1 on each of the two sides. Moreover, a defined positional relation of the switching disc 1 relative to both the dial face 12 and the drive train is always present because only a single coupling possibility of the dog 14 with the clutch aperture 13 exists for the entire 360° circumference of the switching disc 1 and the dial face 12. As shown in FIG. 3, the timer may also include a conventional clock face 20, and as a result of the aforementioned impossibility of erroneously placing the dial face 12 relative to the switching disc 1, it is also impossible to erroneously place the dial face 12 with respect to the clock face 20.

The clock face 20 displaying analog time, and its associated clock drive train for operating the hands, are preferably disposed coaxially with the switching disc 1 and the dial face 12. The mechanism for the clock face 20 may directly mesh with the central drive means or one of the drive tubes 6 or 7. This insures that when the mechanism for the clock face 20 is set, the switching disc 1 and the dial face 12 will also rotate by a corresponding amount, and vice versa.

A further embodiment of a timer device constructed in accordance with the principles of the present invention is shown in FIGS. 4 and 5 wherein components already identified in connection with FIG. 1 are identically referenced. In this embodiment, the dial face 12 has a gear rim 23 mounted at the underside 11 of the dial face 12 and a gear rim 24 mounted at the upper side 15 thereof. The gear rims 23 and 24 are disposed coaxially relative to one another on the dial face 12 and form a unitary element therewith. The gear rims 23 and 24 respectively engage gear pinions 21 and 22 for coupling the switching disc 1 to the central drive means. Coupling of the dial face 12 to the switching disc 1 again occurs by engagement of the clutch aperture 13 and the dog 14.

As shown in FIG. 4, the pinion 21 is engaged with the gear rim 23. The gear ratio for this engagement may correspond to a rotational speed or time range of one revolution per 24 hours. A gear ratio of 1:1 may thus be present for the pinion 21 and the gear rim 23. In accord with this state of the switching disc 1, a 24 hour scale division 19 is provided at the upper side 15 of the dial face 12, as shown in greater detail in FIG. 5. An axial limiting nut 16 is again provided on a threaded bolt 17, the nut 16 having a hollow interior for covering the gear rims 23 and 24.

For changing the speed or time range of the switching disc 1 shown in FIG. 4, the nut 16 is again removed and the dial face 12 is removed from the switching disc 1 and turned over and again put in place on the switching disc 1, being again coupled thereto via the clutch aperture 13 and the dog 14. At the same time the dial face 12 is put in place on the switching disc 1, the gear rim 24 meshes with the gear pinion 22. The gear ratio of the pinion 22 to the gear rim 24 may be 1:7, corresponding to a rotational speed or time range of the switching disc 1 of one revolution per week. The pinions 21 and 22 may be disposed on a common drive shaft. A weekly scale division is provided on what is now the upper side of the dial face 12, the former underside 11.

As described in the following embodiments, the timer device disclosed and claimed herein also permits altering or changing the speed and time range of the timer device without the necessity of turning over the dial face.

As shown in the embodiment in FIG. 6, the switch disc 1 is again seated on a bearing pin 3, however, in this embodiment the bearing pin 3 is not rotatable but instead the switching disc 1 rotates on the bearing pin 3. The drive tubes 6 and 7 are as described above. The switching disc 1 has coupling recesses 10*a* at both an upper side 25 and an underside 26 thereof. The drive tubes 6 and 7 are axially displaceable. Axial displacement of the drive tubes 6 and 7 is achieved by means of a control knob 27 in the form of a disc which rotates together with the switching disc 1, but which is adjustable relative thereto by a certain small angle.

By rotation of the control knob 27 relative to the switching disc 1, not only is one of the drive tubes 6 or 7 coupled to the switching disc 1 by axial displacement (one of the coupling dogs 8*a* or 9*a* engaging with the correspondingly adjacent coupling recess 10*a* on the appropriate side of the switching disc 1) but also one of two scale divisions disposed on the front or top side 25 of the switching disc 1 at different diameters is exposed, while the other scale division is covered by rotation of the control knob 27.

In the embodiment of FIG. 7, the switching disc 1 is again seated on a bearing pin 3 and a control knob 27 in the form of a disc is again seated on the switching disc coaxially relative thereto. The control knob 27 again is rotatable together with the switching disc 1 and can be adjusted relative thereto by a certain small angle. In this embodiment, however, neither the switching disc 1 or the control knob 27 change position. The switching disc 1 is driven by a coupling to the central drive means via one of gear pinions 21 or 22, which are axially displaceable and which are displaced by the control knob 27 for changing speeds. Depending upon the speed selection, either the pinion 22 engages gear rim 28*a* carried on the switching disc 1, or pinion 21 engages gear rim 28*b* carried on the switching disc 1. The speed differential depending upon which gear train couples the switching disc 1 to the central drive means may, for example, have a ratio of 1:7, respectively corresponding to one revolution per 24 hours and one revolution per week.

As shown in FIG. 8, the control knob 27 alternately covers or uncovers (exposes) scale divisions respectively designating one revolution per 24 hours and one revolution per week disposed at different diameters on the top side 25 of the switching disc 1. A time division scale 30*a*, which is exposed by apertures 32 in the knob 27 in the position shown in FIG. 8, is carried on the top side 25 of the switching disc 1, while another scale 30*b* is disposed thereon at a different diameter.

Two embodiments of the switching device claimed herein having a switching barrel or drum instead of a switching disc are shown in FIGS. 9 and 10. The switching barrel 1*a* has the same numerical designations and divisions as the previously-discussed switching discs 1, and performs the same function of moving a plurality of programmable switch actuators 2 into engagement with stationary switch means 5. The switching drum 1*a* in both of the embodiments shown in FIGS. 9 and 10 is rotatable but is axially non-displaceable. The barrel 1*a* has two sets of scale divisions at a circumference 33 thereof.

In the embodiment shown in FIG. 9, the switching barrel 1*a* is axially non-displaceably seated on a bearing pin 3. Two coaxially disposed and axially displaceable drive tubes 6 and 7 are connectable to the switching barrel 1*a* depending upon the speed or time range requirement. Driving engagement of the drive tubes 6 and 7 with the switching barrel 1*a* proceeds by axial displacement of one of the drive tubes 6 or 7 as described above. Axial displacement of the drive tubes 6 and 7 is achieved by a cylindrical mask 34 which is corotatable with the switching barrel 1*a*, but which is axially displaceable relative thereto. The mask 34 has apertures 32 at its circumference for exposing the appropriate scale division. The mask 34 covers the circumference 33 of the switching barrel 1*a* on which the scale divisions are present as a cap.

In the embodiment shown in FIG. 10, drive tube 6 and 7 are not utilized, rather a shaft 35 connected to the mask 34 for axial displacement therewith is employed having two gear rims 35*a* and 35*b* which respectively engage gear pinions 22 and 21, depending upon the position of the mask 34. A releaseable spring-loaded detent locking means 36 is provided for maintaining a selected position of the shaft 35 and the mask 34.

It will be apparent that the embodiment shown in FIG. 10 may be modified such that the barrel 1*a* is axially displaceable in which case axial displacement of the barrel 1*a* will appropriately displace the shaft 35 to engage one of the gear rims 35*a* and 35*b* with one of the pinions 21 or 22. In this case, however, it is necessary that the switch means 5 also be axially displaced in correlation with the axial displacement of the barrel 1*a*. For this purpose, the bearing pin 3 may be extended to encompass the switch means 5 as shown in FIG. 10.

In all embodiments, the element carrying the time scales thereon (the dial face 12 or the drum 1*a*) may be manufactured as a unitary element of a synthetic material with the gear rims and apertures a part thereof. The scale divisions may be imprinted, impressed or adhesively sprayed on the dial face 12 or the barrel 1*a*.

It will also be apparent that although the timer device has been described herein in the context of two available rotational speeds, any number of different rotational speeds may be accommodated by a suitable number of gear rims or drive tubes with appropriate gearing ratios to the central drive means.

Although other modifications and changes may be suggested by those skilled in the art it is the intention of the inventor to embody within the patent warranted hereon all changes and modifications as reasonably and properly come within the scope of his contribution to the art.

I claim as my invention:

1. A multi-range switch device for use with a drive means for actuating a stationary switch means according to a temporal program comprising:

a rotatable switching element carrying a plurality of programmable switch riders for actuating said stationary switch means;

at least two time scales having different time divisions;

at least two drive elements connectable to said drive means for respectively rotating said switching element at different speeds corresponding to said different time scale divisions; and a disengageable coupling means for alternatively connecting said switching element to one of said drive elements and arranged with respect to said time scales for simultaneously exposing the time scale associated with the connected drive element such that said time scale corresponding to said connected drive element can assume only one radial position with respect to said switching element, said one radial position corresponding to a same position for the other time scale before disengagement, whereby said time scale corresponding to said connected drive element is automatically and simultaneously exposed and temporally set upon a change of the connection of said switching element from one drive element to another drive element.

2. The multi-range switch device of claim 1 wherein said switching element is a switching disc.

3. The multi-range switch device of claim 2 wherein said drive elements are first and second drive elements and wherein said time scales are first and second time scales respectively associated therewith, and wherein said coupling means is a coupling disc having said first time scale and an engagement means for engaging said second drive element one one face of said coupling disc, and having said second time scale and an engagement means for engaging said first drive element on an opposite side of said coupling disc, said coupling disc being seated on said switching disc and being turned over for changing the rotational speed of said switching disc.

4. The multi-range switch device of claim 3 wherein each of said drive elements is a drive tube said drive tubes having different diameters and being coaxially disposed and wherein said switching disc and said coupling disc are also coaxially disposed with respect to said drive tubes, and wherein said engagement means carried on opposite sides of said coupling disc are disposed thereon at different diameters for respective engagement with said drive tubes.

5. The multi-range switch device of claim 4 wherein said engagement means on said coupling disc are dogs, and wherein said drive tubes have corresponding apertures for receiving said dogs.

6. The multi-range switch device of claim 3 wherein said first and second drive elements are gear pinions of different diameters, and wherein said engagement means on said coupling disc are gear rims carried on opposite sides thereof having different diameters for respectively meshing with one of said gear pinions.

7. The multi-range switch device of claim 6 wherein said gear pinions are mounted on a common shaft.

8. The multi-range switch device of claim 3 wherein said switching disc has a dog thereon and wherein said coupling disc has an aperture for receiving said switching disc dog such that said coupling disc may assume only one rotational position relative to said switching disc.

9. The multi-range switch device of claim 2 further comprising a standard analog clock face disposed at a center of said switching disc and wherein said coupling means is a coupling ring coaxially disposed with respect to said clock face and said switching disc and surrounding said clock face.

10. The multi-range switching device of claim 1 further comprising a removable axial limiting nut for holding said coupling means against said switching element.

11. The multi-range switch device of claim 2 wherein each of said drive element is an axially displaceable drive tube, said drive tubes having different diameters and being coaxially disposed with respect to said switching disc, said switching disc having engagement means on opposite sides thereof for respectively engaging one of said drive tubes, and wherein said coupling means includes a control knob coaxially seated on said switching disc and rotatable through a limited small angle with respect to said switching disc for axially displacing said drive tubes such that a selected one of said drive tubes is in driving engagement with said switching disc, and wherein said time scale divisions are disposed in circles of different diameters on a face of said switching disc adjacent to said control knob, said control knob having apertures such that rotation of said control knob through said limited angle exposes the time scale division associated with the drive train in driving engagement with said switching disc.

12. The multi-range switch device of claim 11 wherein each of said drive tubes has a gear rim thereon, said gear rims having different diameters, and wherein each of said drive elements is a gear pinion, said gear pinions having different diameters for respectively meshing with one of said gear rims.

13. The multi-range switch device of claim 12 wherein said gear pinions are mounted on the same shaft.

14. The multi-range switch device of claim 2 wherein each of said drive element is a gear pinion, said gear pinions having different diameters, and wherein said coupling means includes a bearing axle connected to said switching disc and having two gear rims of different diameters thereon for respectively meshing with one of said gear pinions, and a control knob coaxially seated adjacent to said switching disc and rotatable with respect thereto through a limited angle for axially displacing said switching disc and said bearing axle for engaging a selected one of said gear rims with one of said gear pinions.

15. The multi-range switch device of claim 14 wherein said gear pinions are mounted on the same shaft.

16. The multi-range switch device of claim 14 wherein said switching disc has two time scale divisions disposed in circles of different diameters on a face thereof, and wherein said control knob has apertures such that rotation of said control knob through said limited angle exposes the time scale division associated with the drive train in driving engagement with said switching disc.

17. The multi-range switch device of claim 1 wherein said each of said drive elements is a drive tube, said drive tubes being of different diameters and being coaxially mounted relative to one another, and wherein said switching element is a switching drum having at least two time scale divisions on a circumference thereof respectively corresponding to the speed of rotation of said drive tubes, said time scale divisions being in axial adjacency, and wherein said coupling means includes a barrel-like mask partially covering said switching barrel circumference and being corotatable with said switching drum, said mask being axially displaceable for placing one of said drive tubes in driving engagement with said switching drum, and said mask having apertures therein for exposing one of said time scales upon axial displacement of said mask, said exposed time scale corresponding to said drive element which is in driving engagement with said switching drum, whereby said time scale corresponding to the drive tube in driving engagement with said switching drum is automatically and simultaneously exposed and temporally set upon axial displacement of said mask.

18. The multi-range switch device of claim 17 wherein each of said drive tubes has a gear rim thereon, said gear rims having different diameters, and wherein each of said drive trains has a gear pinion, said gear pinions being of different diameters for respectively meshing with one of said gear rims.

19. The multi-range switch device of claim 18 wherein said gear pinions are mounted on the same shaft.

20. The multi-range switch device of claim 1 wherein said switching element is a switching barrel having a bearing axle with gear rims of different diameters thereon for respectively engaging said different drive elements, said switching barrel having two time scales thereon disposed at a circumference thereof in axial adjacency, and wherein said coupling means includes a barrel-like mask coaxially disposed with respect to said switching barrel for axially displacing said switching barrel and said bearing axle for engaging one of said gear rims with one of said drive elements, said mask having apertures therein for exposing one of said time scales upon axial displacement of said mask, said exposed time scale corresponding to the rotational speed of the drive element in driving engagement with said switching barrel.

21. The multi-range switch device of claim 1 wherein the number of drive elements is two, said two drive elements respectively rotating said switching element in a ratio of 1:7.

22. The multi-range switch device of claim 1 wherein one of said drive elements rotates said switching element at one revolution per 24 hours, and another of said drive elements rotates said switching element at one revolution per week.

23. The multi-range switch device of claim 1 wherein said coupling means is a one-piece element.

24. The multi-range switch device of claim 23 wherein said one-piece element is comprised of a synthetic material.

25. The multi-range switch device of claim 1 wherein said time scale divisions are printed on said coupling means.

26. The multi-range switch device of claim 1 wherein said time scale divisions are impressed on said coupling means.

27. The multi-range switch device of claim 1 wherein said time scale divisions are adhesively sprayed on said coupling means.

* * * * *